US005174500A

United States Patent [19]

Yianilos

[11] Patent Number: 5,174,500

[45] Date of Patent: Dec. 29, 1992

[54] FAIL SAFE LAWN SPRINKLER DEVICE

[76] Inventor: Nicholas P. Yianilos, 2807 NE. 36th St., Fort Lauderdale, Fla. 33308

[21] Appl. No.: 676,786

[22] Filed: Mar. 28, 1991

[51] Int. Cl.[5] ..... B05B 15/06; B05B 1/30

[52] U.S. Cl. ..... 239/201; 239/533.15; 239/570; 137/68.1

[58] Field of Search ..... 239/200, 201, 202, 570, 239/571, 533.15; 137/68.1

[56] References Cited

U.S. PATENT DOCUMENTS

| | | | |
|---|---|---|---|
| 3,735,777 | 5/1973 | Katzer et al. | 137/540 |
| 4,393,992 | 7/1983 | Strunk et al. | 239/200 |
| 4,562,962 | 1/1986 | Hartman | 239/200 |
| 4,762,140 | 8/1988 | Davis | 137/68.1 |
| 4,825,897 | 5/1989 | Shade | 239/571 |
| 4,842,198 | 6/1989 | Chang | 239/570 |
| 4,848,661 | 7/1989 | Palmer et al. | 137/68.1 |
| 4,852,602 | 8/1989 | McKinnon | 137/68.1 |
| 4,867,603 | 9/1989 | Chang | 239/570 |

*Primary Examiner*—Andres Kashnikow
*Assistant Examiner*—Christopher G. Trainor
*Attorney, Agent, or Firm*—Kinzer, Plyer, Dorn, McEachran & Jambor

[57] ABSTRACT

A sprinkler head assembly for a lawn sprinkler system includes a valve having a valve actuating member which is engaged by the sprinkler head when the sprinkler head is in place, the valve is in an open condition, permitting water flow through a tap to the sprinkler head. When the sprinkler head is removed, the valve is operated to a closed condition, cutting off the flow of water through the tap.

7 Claims, 3 Drawing Sheets

FAIL SAFE LAWN SPRINKLER DEVICE

BACKGROUND OF THE INVENTION

This invention relates to lawn sprinkler systems, and more particularly to an improved sprinkler head assembly for such systems.

In lawn sprinkler systems, water supply pipes are buried in the lawn slightly below ground level and water taps or outlets are provided at a plurality of locations, each tap having a sprinkler head located near ground level for directing the supply of water to the lawn in which the lawn sprinkler system is installed. The sprinkler heads both limit the rate of flow of water from the water supply pipes and define a spray pattern typically over an area 360° around the sprinkler head. Because the sprinkler heads are located above ground level, the sprinkler heads may be knocked off inadvertently due to being struck by a lawn mower, because of vandalism, or for other reasons. If, for any reason, a sprinkler head is not in place when water under pressure is supplied to the water supply pipes of the lawn sprinkling system, water will flow freely and uncontrolled through the tap that is missing its associated sprinkler head. This will result both in waste of water, and in the flooding with water of a very small area of the lawn which could result in damage to the lawn and the subsoil. The waste of water and the potential damage to a lawn could be extensive for lawn sprinkler systems controlled by a timer. In such systems, water is supplied to the water supply pipes automatically and periodically and wasting of water could continue unnoticed for extended periods of time.

SUMMARY OF THE INVENTION

It is therefore an object of the present invention to provide an improved sprinkler head assembly for use in lawn sprinkler systems automatically prevents the free flow of water through the sprinkler head assembly in the event a sprinkler head is removed either intentionally or unintentionally.

Another object of the invention is to provide an improved sprinkler head assembly for use in lawn sprinkler systems including a sprinkler head and a flow control assembly which controls and/or stops the flow of water through a tap if the sprinkler head is not in place.

These and other objects of the invention are achieved by the present invention which provides a sprinkler head assembly for use in lawn sprinkler systems of the type including a water supply pipe having a plurality of taps. The sprinkler head assembly comprises valve means in series with the tap and the sprinkler head. The valve means is operable between a water flow permitting position and a water flow preventing position. The sprinkler head maintains the valve means in its flow permitting position, but the valve means is operated to its full preventing position by water pressure whenever the sprinkler head is not in place.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENTS

Figure 1:
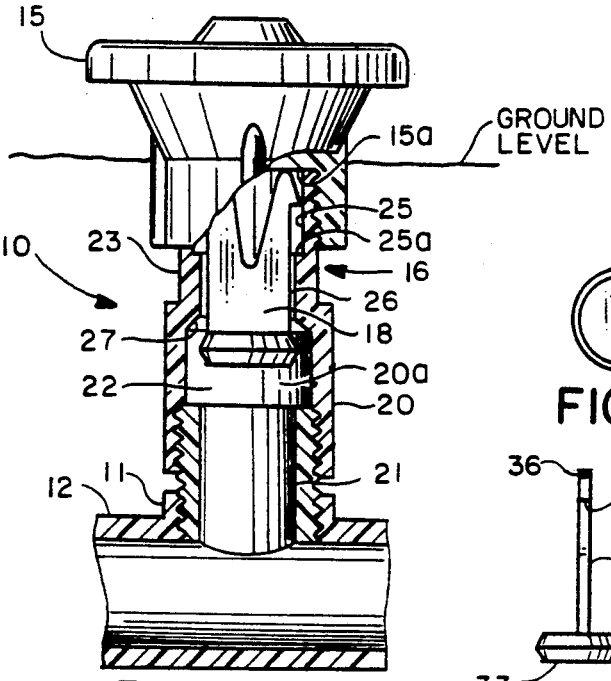
FIG. 1 is a side elevational view, partially in section, of a sprinkler head assembly provided by the present invention, shown mounted on a tap of a water supply pipe of a lawn sprinkler system.
Figure 2:
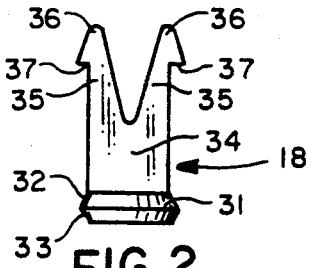
FIG 2 is a front elevational view of a valve member of the sprinkler head assembly illustrated in FIG. 1.
Figure 3:
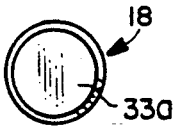
FIG. 3 is a bottom plan view of the valve member of FIG. 2.
Figure 4:
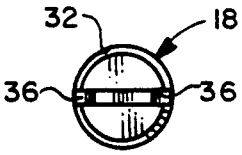
FIG. 4 is as top plan of the valve member of FIG. 2.
Figure 5:
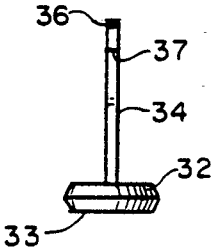
FIG. 5 is a side elevational view of the valve member of FIG. 2.

Referring to FIG. 1, the sprinkler head assembly provided by the present invention is indicated generally by reference numeral 10 and is shown mounted on a tap 11 of a water supply pipe 12 of a lawn sprinkler system. The water supply pipe 12 is embedded slightly below ground level as is known in the art. The sprinkler head assembly 10 includes a sprinkler head 15 which is located near ground level. Although only one sprinkler head assembly 10 is illustrated in FIG. 1, it is apparent that a plurality of such sprinkler head assemblies would be provided, each mounted on an individual tap of a water supply pipe of a network of water supply pipes which are embedded in a lawn. The sprinkler head 15 is conventional.

The sprinkler head assembly 10 includes the sprinkler head 15 and a valve assembly 16 which couples the sprinkler head 15 to the tap 11. The valve assembly 16 includes a valve member 18, a coupling member 20, and a short nipple 21. The coupling member 20 is connected to the tap 11 by the nipple 21 and has male threads at its upper end which engage female threads on the sprinkler head 15. The valve member 18 is located within a central axial bore 20*a* of the coupling member 20 and movable axially thereof in a vertical direction between an open or flow permitting position illustrated in FIG. 1 and a closed or flow preventing position illustrated in FIG. 6, as will be shown. The sprinkler head 15 maintains the valve member 18 in its flow permitting position as illustrated in FIG. 1. However, when the sprinkler head 15 is not in place on the assembly as illustrated in FIG. 6, the valve member 18 is free to move in response to the flow of water through the tap 11 to its flow preventing position, as illustrated in FIG. 6, when water under pressure is being supplied to the water supply pipe 12.

Figure 6:
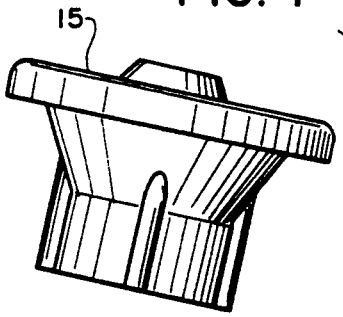
FIG. 6 is a view similar to FIG. 1 but with the sprinkler head removed and the valve illustrated operated to its flow preventing condition.
Figure 6:
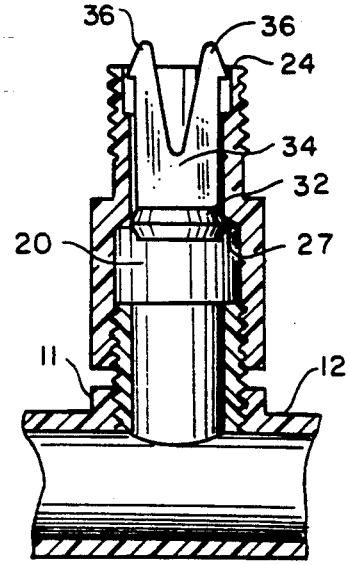
Figure 7:
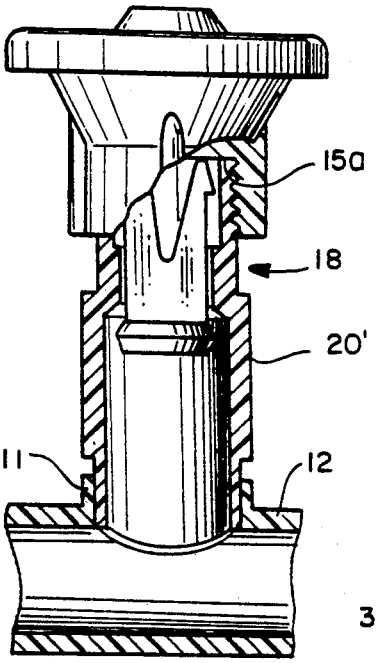
FIG. 7 is a side elevational view, partially in section, of a further embodiment for a sprinkler head assembly provided by the present invention.

Referring to FIGS. 1 and 6, the coupling member 20 is hollow and generally cylindrical in shape defining a water inlet compartment 22 at its lower edge. The coupling member 20 has a necked down upper portion 23 which is countersunk near its upper edge 24 defining an enlarged annular bore 25 with a shoulder 25*a* at its lower end. The annular bore 25 is communicated with the water inlet compartment 22 through a narrow inner diameter portion 26 of the coupling member. The portion 27 of the inner wall of the coupling member adjacent to its reduced diameter portion 26 is tapered, defining a valve seat for the valve assembly 16. The coupling member 20 and the nipple 21 are molded of plastic or other suitable material. Although the coupling member 20 and the nipple 21 are shown in FIG. 1 as separate elements, they may be molded as a one-piece plastic member 20*a*, as illustrated in FIG. 7.

Referring to FIGS. 2-5, the valve member 18 includes a base portion 31 which is generally frustoconical in shape and defining a tapered sealing surface 32 extending vertically upward and inwardly from an annular base portion 33. The valve member 18 has a flat, generally circular bottom 33*a*. The valve member 18 is bifurcated and includes a yoke 34 having a pair of upwardly extending leg members 35 which terminate in generally triangular shaped cam tip portions 36. The cam portions 36 increase in width from top to bottom of the leg members, defining overhang portions 37. The leg members 35 are of a sufficient length to permit them to flex past the valve seat 27 upon installation of the valve closing member.

As shown in FIGS. 1 and 6, the overhang portions 37 of the triangular tip portions 36 extend into the annular bore 25 of the coupling member 20 and the undersides of the overhang portions 37 rest on the shoulder 25*a* of coupling member 20 when the valve member 18 is in its flow permitting position. The transverse width of the valve member 18, measured at the overhang portions 37 of its tips, corresponds to the inner diameter of the annular bore 25 of the coupling member.

Referring to FIGS. 1 and 6, the sprinkler head assembly 10 is mounted on the tap 11 of the water supply pipe 12 as shown in FIG. 1. In the absence of water flow through the supply pipe 12, the tip portions 36 of the valve member 18 rest on the shoulder 25*a* of the coupling member. When water is being supplied to the tap 11 through the water supply pipe 12, the water pressure will move the valve member 18 vertically upwardly, slightly, until the tip portions 36 engage the undersurface 15*a* of the sprinkler head 15, permitting water to flow through the tap 11 around the valve head portion 32 and through the reduced diameter portion 26 of the coupling member 20 and the bore 25 to the inlet of the sprinkler head 15. Water thus supplied to the sprinkler head 15 flows out through the sprinkler head 15 in the pattern established by the sprinkler head.

When the sprinkler head 15 is in place and its undersurface 15*a* engages the legs 35, upward travel of the valve member 18 is limited so as to maintain the valve head 32 out of engagement with the valve seat 27.

If the sprinkler head 15 is not in place on the tap as illustrated in FIG. 6, the valve member 18 is permitted to move upwardly under the force of water supplied through the water supply pipe 12 to its flow preventing position such that its valve surface 32 engages the valve seat 27, sealing the outlet through the reduced diameter portion 26 and bore 25 of the coupling member 20. This shuts off the flow of water through the tap 11. Thus, the sprinkler head assembly 10 with the valve assembly 16 according to the present invention, permits water to flow out of the tap 11 only when the sprinkler head 15 is in place.

Figure 8:
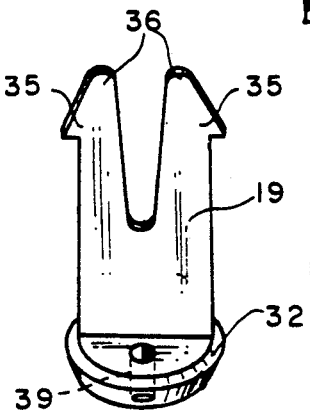
FIG. 8 is a front elevational view of another embodiment for a valve member for a sprinkler head assembly provided by the present invention.
Figure 9:
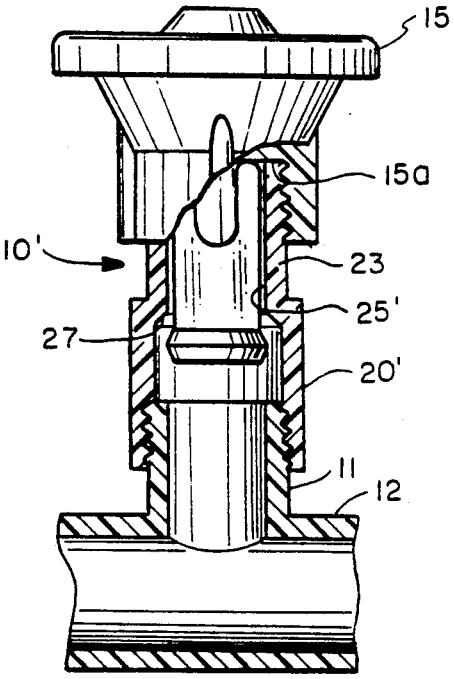
FIG. 9 is a side elevational view, partially in section of a further embodiment of a sprinkler head assembly provided by the present invention, shown mounted on a tap of a water supply pipe of a lawn sprinkler system.
Figure 10:
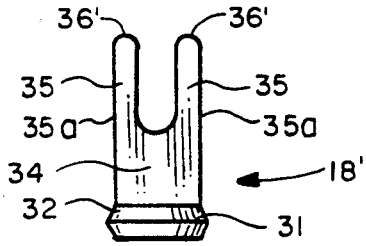
FIG. 10 is a front elevational view of a valve member of the sprinkler head assembly illustrated in FIG. 9.
Figure 11:
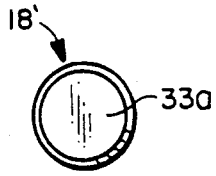
FIG. 11 is a bottom plan view of the valve member of FIG. 10.
Figure 12:
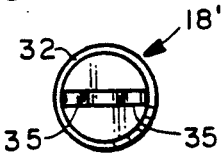
FIG. 12 is as top plan of the valve member of FIG. 10.
Figure 13:
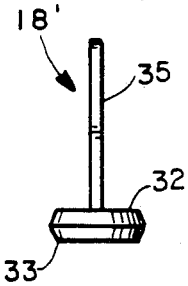
FIG. 13 is a side elevational view of the valve member of FIG. 10.
Figure 14:
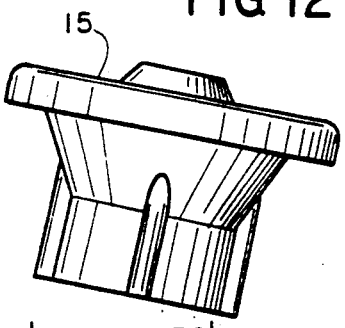
FIG. 14 is a view similar to FIG. 9 but with the sprinkler head removed and the valve illustrated operated to its flow preventing condition.
Figure 14:
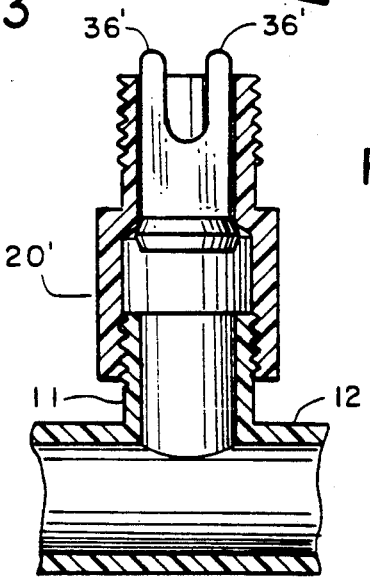

In some instances, it may be desirable to have some indication that the sprinkler head 15 is not in place. Accordingly, as illustrated in FIG. 8, there is provided a valve member 19 which has an aperture 39 through the base portion of the valve element, so that when the valve member 19 is operated to its valve closing or water flow preventing position illustrated in FIG. 6, a trickle of water is permitted to flow through the aperture 39. This water flow provides an indication of the absence of a sprinkler head 15 at that position.

FIGS. 9-14 illustrate a valve assembly 10' which is similar to valve assembly 10 illustrated in FIG. 1. Elements of the valve assembly 10' which are the same as in valve assembly 10 have been given the same reference numerals, and similar elements have been given the same reference numerals with a "prime" notation. Valve assembly 10' includes a coupling member 20' which has a straight inner wall 25' and a valve member 18' which has a pair of upwardly extending leg portions 35 which terminate in arcuate tip portions 36'. The leg portions 35' are spaced apart, defining a lateral width for the valve member 18'which corresponds to the inner bore 25' of the coupling member 20'. The outer edges 35*a* of the leg members 35 ride along the inner surface 25' of the coupling member 20'. Valve member 18' has a base portion 31 with a tapered sealing surface 32 which cooperates with tapered portion 27 of the inner surface of the coupling member 20' to define a valve which is interposed between the outlet of the tap 11 and the sprinkler head 15. The manner in which valve head assembly 10' operates is similar to that for valve assembly 10 as described above.

Figure 15:
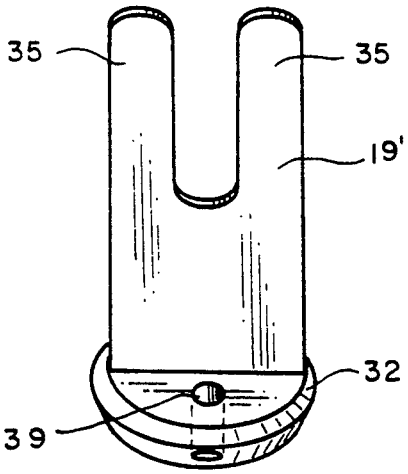
FIG. 15 is a front elevational view of another embodiment for a valve member for a sprinkler head assembly illustrated in FIG. 9.

Referring to FIG. 15, there is illustrated a valve member 19' which is similar in configuration to valve member 18' for the valve assembly 10' illustrated in FIGS. 9-14, but valve member 19' has an aperture 39 therethrough similar to that for the valve member 19 shown in FIG. 8. With this arrangement, when the valve member 19' is operated to its valve closing or water flow preventing position, illustrated in FIG. 14 for valve member 18', a trickle of water is permitted to flow through the aperture 39 to provide an indication of the absence of the sprinkler head 15 at the position at which the valve assembly including valve member 19' is located.

Figure 16:
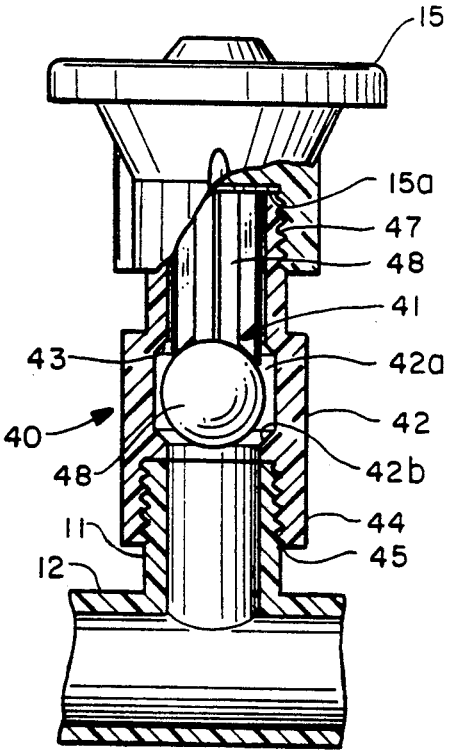
FIG. 16 is a side elevational view, partially in section, of a further embodiment for a sprinkler head assembly provided by the present invention.
Figure 17:
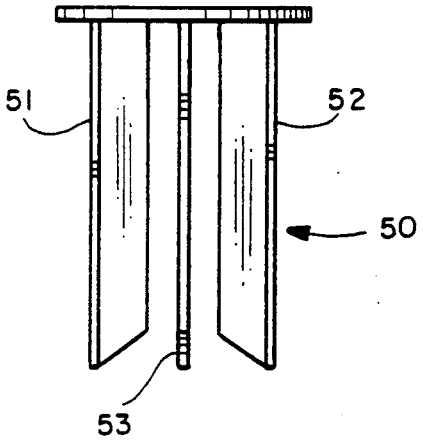
FIG. 17 is a front elevational view of the valve member for the sprinkler head assembly shown in FIG. 16.
Figure 18:
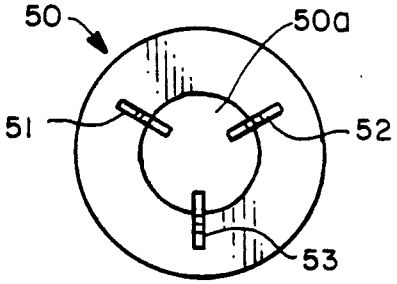
FIG. 18 is a bottom plan view of the valve member of FIG. 17.

Referring now to FIGS. 16–19, there is illustrated a further embodiment of a valve assembly 41 for a sprinkler head assembly 40 for use in a lawn sprinkler system. The valve assembly 16' includes a ball check valve including valve seat 43 and a spherical ball valve member 48, and a valve actuating member 50. In the valve assembly 41, the coupling member 42 has a generally cylindrical inner cavity 42*a* having a lower necked down portion defined by tapered surface 42*b* and an upper necked down portion defined by tapered surface which defines the valve seat 43. The lower end 44 of coupling member 42 is adapted with internal female threads 45 for coupling to the tap 11 of the water supply pipe 12. The upper end 46 of the coupling member 42 has male threads 47 for coupling with female threads of the sprinkler head 15. The spherical-shaped valve member 48 is located within cavity 42*a* and is adapted to seat with the valve seat 43 defined by tapered surface 42*b* near the upper necked down portion of the coupling member 42. The valve actuating member 50 comprises an annular disc-shaped base portion 49 having a central aperture 50*a* therethrough and three depending legs 51, 52 and 53. The actuating member 50 is positioned with its legs 51–53 extending into the upper necked down portion of the coupling member 42. The length of the legs 51–53 is sufficient to assure that the valve member 48 is maintained disengaged from the seat 43 when the valve member is in place. The valve actuating member 50 is held in place on the coupling member 42 by the sprinkler head 15 as illustrated in FIG. 16.

Figure 19:
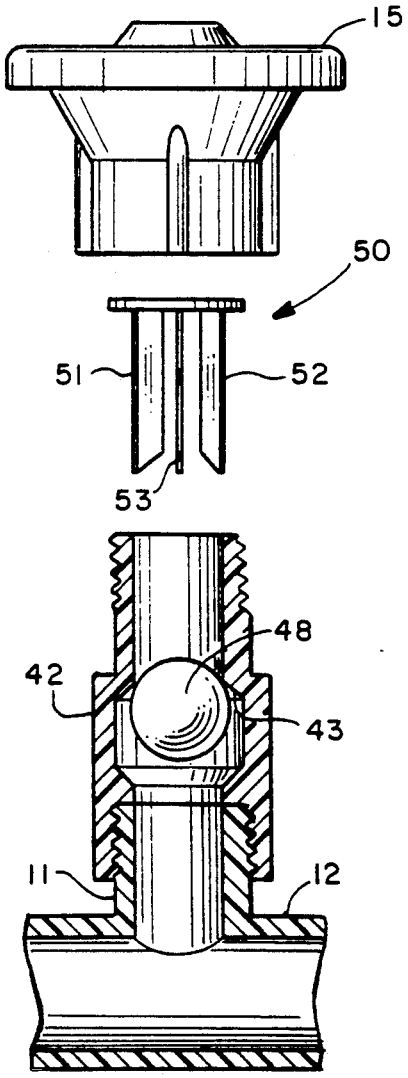
FIG. 19 is a view similar to FIG. 16, but with the sprinkler head removed and the valve illustrated operated to its flow preventing condition.

Referring to FIG. 19, when the sprinkler head 15 is removed from the coupling member 42, then when water is being supplied through the water supply pipe 12, the valve member 50 is driven vertically upwardly by the force of the water, driving the actuating member 50 upwardly because the sprinkler head 15 is no longer in place to maintain the valve actuating member 50 in place. This allows the valve member 48 to seat against the valve seat 43, closing the valve and shutting off the flow of water through the sprinkler head assembly 40.

I claim:

1. In a lawn sprinkler system including water supply means having a plurality of taps, each tap having a sprinkler head mounted thereon for controlling and directing the flow of water from the tap, the improvement comprising: a valve assembly for each sprinkler head for connecting the associated sprinkler head to its associated tap in fluid communication therewith, said valve assembly including valve means operable between an open condition which permits water to flow from the tap to the sprinkler head and a closed condition which prevents water from flowing from the tap to the sprinkler head, said valve means being prevented from being operated to its closed condition when the sprinkler head is mounted on said valve assembly, and when the sprinkler head is removed from said valve assembly, said valve means being operated to its closed condition in response to the flow of water through the tap, said valve means comprising a valve seat, a valve closing member movable relative to said valve seat and having actuating means engaged by the sprinkler head when the sprinkler head is mounted on said valve assembly for maintaining said valve closing member out of engagement with the said valve seat, thereby maintaining said valve means in its open condition, said actuating means comprising a bifurcated member having first and second leg portions of sufficient free length to permit the leg portions to flex past the valve seat upon installation of the valve closing member.

2. A lawn sprinkler system according to claim 1, wherein said valve assembly includes a coupling member coupling the sprinkler head to the tap, and having an axial bore therethrough, said coupling member having said valve seat defined on an inner surface thereof in said axial bore, said valve closing member being located in said bore of said coupling member and being movable axially thereof into and out of engagement with said valve seat.

3. A lawn sprinkler system according to claim 2, wherein said coupling member comprises a section of pipe.

4. A lawn sprinkler system according to claim 2, wherein said closing member is generally disc-shaped and said first and second leg portions extend upwardly in said axial bore.

5. A lawn sprinkler system according to claim 4, wherein said bifurcated member defines first and second cam surfaces near distal ends of said leg portions and diametrically opposed in said axial bore and engaging said inner surface of said coupling member.

6. A lawn sprinkler system according to claim 4, wherein said first and second leg portions have distal tips which are engaged by an undersurface of the sprinkler head when the sprinkler head is mounted on said valve assembly.

7. A lawn sprinkler system according to claim 4, wherein said closing member has a fluid flow passageway therein for permitting limited fluid flow through said valve means while said valve member is in engagement with said valve seat.

* * * * *